United States Patent [19]

Keritsis et al.

[11] 4,341,228

[45] Jul. 27, 1982

[54] METHOD FOR EMPLOYING TOBACCO DUST IN A PAPER-MAKING TYPE PREPARATION OF RECONSTITUTED TOBACCO AND THE SMOKING MATERIAL PRODUCED THEREBY

[75] Inventors: Gus D. Keritsis; David A. Lowitz, both of Richmond, Va.

[73] Assignee: Philip Morris Incorporated, New York, N.Y.

[21] Appl. No.: 223,035

[22] Filed: Jan. 7, 1981

[51] Int. Cl.[3] ..... A24B 3/14

[52] U.S. Cl. ..... 131/354; 131/355; 131/374

[58] Field of Search ..... 131/354, 355, 357, 358, 131/371–375

[56] References Cited

U.S. PATENT DOCUMENTS

| | | | |
|---|---|---|---|
| 3,012,915 | 12/1961 | Howard | 131/354 |
| 3,136,321 | 6/1964 | Davis | 131/371 |
| 4,182,349 | 1/1980 | Selke | 131/374 |

FOREIGN PATENT DOCUMENTS

| | | | |
|---|---|---|---|
| 509941 | 2/1955 | Canada | 131/370 |
| 6713309 | 4/1968 | Netherlands | 131/370 |

*Primary Examiner*—V. Millin

*Attorney, Agent, or Firm*—Arthur I. Palmer, Jr.; George E. Inskeep

[57] ABSTRACT

A method for employing tobacco dust in a paper-making process for the preparation of reconstituted tobacco is disclosed. The method for employing the tobacco dust comprises admixing tobacco dust with a bonding material to form a mixture, treating the mixture to form agglomerated particles, admixing the agglomerated particles with a tobacco-parts slurry and then forming the slurry into a sheet by means of a paper-making process, drying and then shredding the resultant reconstituted tobacco sheet. The smoking material obtained by such method is also described.

35 Claims, No Drawings

METHOD FOR EMPLOYING TOBACCO DUST IN A PAPER-MAKING TYPE PREPARATION OF RECONSTITUTED TOBACCO AND THE SMOKING MATERIAL PRODUCED THEREBY

BACKGROUND OF THE INVENTION

1. Field of the Invention

This invention pertains to the field of smoking materials. More particularly, the present invention concerns a method for preparing a smoking material with reconstituted tobacco having incorporated therein fine tobacco dust.

2. Description of the Prior Art

As a result of treating, handling and shipping tobacco in its various forms, i.e., cigar wrappers or fillers, cigarettes, smoking tobacco, etc., tobacco dust is generally formed. This dust, generally less than about 60 mesh in size, is recovered from air filters, tobacco screens and other like separating systems. Generally, it has been desirable to employ this tobacco dust in conjunction with other tobacco by-products, such as, stems, stalks and leaf scraps resulting from the stripping of leaf tobacco, in the preparation of reconstituted tobacco material.

One process for making reconstituted tobacco sheets involves casting or forming a paste or slurry of refined tobacco by-products, including tobacco dust, onto a moving belt. In such a technique, the employment of very fine tobacco particles is feasible inasmuch as these tobacco dust particles are simply retained on the moving belt, present no manufacturing difficulties and are not lost during the sheet formation. This is not, however, true in a paper-making type process for operation of reconstituted tobacco.

More particularly, when employing a paper-making process for preparing reconstituted tobacco, the tobacco dust must generally be discarded or employed elsewhere. This is due to the fact that in the paper-making process, the slurry of refined tobacco-by-products is cast from a head box onto a wire screen for forming the desired sheet. If the screen mesh size is too large, the dust particles simply pass through the wire screen and do not, as a result, become incorporated in the resulting sheet. Conversely, when the screen mesh size is reduced so as to prevent the tobacco dust particles from passing therethrough, the dust considerably slows the drainage of the water through the screen and correspondingly slows the rate of sheet formation by actually plugging and/or clogging the wire screen openings. Moreover, once the sheet has finally been formed, it is very difficult to remove it from the wire screen due to the dust particles becoming embedded into the screen openings.

Accordingly, although the paper-making type process for making reconstituted tobacco material has many advantages over the alternative casting/moving belt type method, particularly, in that a binder is not required to hold the fibers together and a significant amount of solubles can be removed from the tobacco material to be treated separately and later reincorporated in the resulting sheet, and is consequently the preferred method, it nevertheless does suffer from the disadvantage of not being able to efficiently and conveniently employ tobacco dust by-product. A means for employing tobacco dust in such a process has long been desirable but has not been known heretofore.

SUMMARY OF THE INVENTION

Applicants have discovered a process which avoids substantially all of the above-noted disadvantages associated with a paper-making type process in the preparation of reconstituted tobacco containing tobacco dust which is employed as a smoking material alone or in combination with other smoking materials such as natural leaf tobacco.

In particular, applicants have discovered a method for producing a smoking material which economically utilizes tobacco dust by-product in a paper-making type process for making reconstituted tobacco. This method not only prevents the loss of the dust through the wire screen when the screen openings are too large and furthermore prevents clogging and/or plugging of the screen openings when these openings are too small, but additionally, the method of the present invention actually increases the rate of drainage through the wire screen correspondingly increasing the rate of production of the reconstituted tobacco sheets.

More particularly, the present invention is directed to a method for employing tobacco dust in the preparation of reconstituted tobacco which comprises admixing tobacco dust with a bonding material to form a mixture, treating the mixture to form agglomerated particles, admixing the agglomerated particles with a tobacco-parts slurry and forming the slurry into a sheet by means of a paper-making process, drying and then shredding the resultant reconstituted tobacco sheet.

More specifically, the tobacco dust material is added to or blended with a dispersion or solution of a bonding material which is then formed by suitable techniques into fibers or sheets with simultaneous or subsequent conversion into a relatively water-resistant form. Where a sheet is formed, it is subsequently shredded and cut into short fiber lengths. Where fibers are formed, they are chopped as necessary. The water resistant fibers are then combined and thoroughly mixed with a refined tobacco-parts slurry commonly known as "pulp" and transferred to the head box of a Fourdrinier or similar sheet-making apparatus in which the resulting sheet of reconstituted tobacco is formed.

This invention enables the utilization of tobacco dust by-product material in conjunction with the preferred paper-making process for the manufacture of reconstituted tobacco material. The method of the present invention not only economically utilizes tobacco dust in a paper-making technique which has not been successfully done in the prior art but, in fact, substantially improves this technique by increasing the rate of drainage during the sheet forming step at the wire screen resulting in yet an additional economic advantage over the prior art technique.

DETAILED DESCRIPTION OF THE INVENTION

The method for utilizing tobacco dust material in the preparation of reconstituted tobacco employing a paper-making process is generally carried out as follows:

Tobacco dust by-product material is first collected. Although the method of the present invention is particularly advantageous with dust which is generally less than about 60 mesh in size, the actual size of the dust particles employed is not at all critical to the present invention.

The tobacco dust is then uniformly admixed with a bonding material which, as the term implies, causes bonding and agglomeration of the tobacco dust particles. The bonding materials that may be employed in the process of the present invention include those materials which by themselves cause bonding and agglomeration of the tobacco dust particles and also include those materials which indirectly cause such bonding and agglomeration by having the effect of releasing naturally occurring bonding agents contained within the tobacco dust itself which agents subsequently cause the actual bonding and agglomeration of the tobacco dust.

Bonding materials which by themselves cause bonding and agglomeration of the tobacco dust include, for example, film-forming materials, cross-linking agents and the like.

Film-forming materials and the techniques for converting these materials into water-insoluble fibers, sheets, etc., are well known in the art. Such film-forming materials and the corresponding techniques for their insolubilization are disclosed, for example, in "Man-Made Fibres" by R. W. Moncrieff, fourth edition (John Wiley & Sons Inc., New York, 1963), incorporated herein by reference as if set out in full.

Generally, the types of film-forming material which are applicable to and which may be employed in the present invention include polymers and resins selected from the classes of polysaccharides and their derivatives, synthetic thermoplastic film formers and the like.

Typical polysaccharides include natural gums, algins, pectins, xanthomonas gums and their salts (Na, K, $NH_4$, etc.) chitosan and its salts (acetate, chloride, etc.) and the like.

Suitable polysaccharide derivatives include cellulose ethers and esters, carboxymethyl cellulose (CMC), carboxymethyl guar, methyl cellulose, ethyl cellulose, ethyl hydroxyethyl cellulose, hydroxypropyl cellulose, cellulose acetate, and the like.

Typical synthetic film-forming resins include polyvinyl alcohol, polyvinyl acetate, polyacrylic acid, copolymers of methyl vinyl ether and maleic anhydride and salts thereof.

Depending upon the particular film-forming material employed, and the particular technique for insolubilizing the material to form the desired agglomerated insolubilized particles of the material having tobacco dust uniformly blended therethrough, the starting film-forming material to which the tobacco dust is added and blended with will either be an aqueous or non-aqueous dispersion or solution of the film-forming material.

More particularly, various means exist for insolubilizing a particular film-forming material. Thus, in a dry-spinning technique, for example, certain polymers, such as ethyl cellulose, ethyl hydroxyethyl cellulose, cellulose acetate, and the like, are dissolved in an easy to evaporate, non-aqueous solvent, such as acetone, ethanol, and the like, and then spun or extruded into a desired shape. As this spinning or extrusion is taking place, the resulting fibers or extrudate is heated so as to evaporate the solvent causing the film-forming polymer to set.

Alternatively, in a wet-spinning technique, which is also well known in the art, various chemical reactions are allowed to take place which causes the insolubilization of the film-forming materials. Thus, particular ionic polymers such as chitosan, alginate, pectin, CMC, or the like, are water soluble at one pH and insoluble at another. Accordingly, a water-soluble form of the polymer may be employed as a starting solution and then be spun or extruded into a desired shape into a water bath maintained at a particular pH or containing insolubilizing agents which precipitate the polymer to its water-insoluble form. For example, an aqueous resin dispersion or solution of a resin selected from the polysaccharide class, i.e., algins, pectins, chitosan or the like, is prepared and then blended with tobacco dust to form a mixture. Precipitation and insolubilization will result by extruding the mixture into a solution of aqueous acid or aqueous polyvalent metal salts for algins or pectins or a solution of an aqueous base for chitosan.

Similarly, other wet-spinning techniques take advantage of the fact that particular polymers are water-soluble and organic solvent insoluble. Such polymers include pectins, alginates, CMC, chitosan, and the like. In such cases the water-soluble polymer is spun into a bath containing the particular organic solvent which is necessary for coagulation such as ethanol, acetone, or isopropanol. The reverse of the foregoing solubility properties can also be utilized to form insolubilized agglomerated particles of the film-forming material uniformly blended with the tobacco dust. Thus, polymers such as ethyl cellulose, ethyl hydroxyethyl cellulose, cellulose acetate, and methyl cellulose may be dissolved in an organic solvent and then spun or extruded into water, or another organic liquid which is a solvent for the former solvent but not for the polymeric resin.

In yet another technique, the dispersions containing the film-forming material and the tobacco dust may be cast or extruded in sheet form, dried and the resulting sheet then treated with an insolubilizing agent prior to or after being shredded for subsequent processing.

In still another technique for insolubilizing the film-forming materials, cross-linking agents other than polyvalent metal ions are also well known for imparting water resistance to appropriate resins. More particularly, film-forming materials containing hydroxy, NH, and/or $NH_2$ groups such as glycols, polyols (polyesters, polyethers), sugars, carbohydrates (cellulose, carboxymethyl cellulose, and their various salts, etc.), proteins, urea, amino-sugars (chitin, chitosan, etc.) and the like may be cross-linked with (a) polyfunctional acids (two or more carboxylic groups), (b) acid chlorides of the polyfunctional carboxylic acids (e.g., adipoyl chloride, etc.), (c) acid anhydrides of polyfunctional carboxylic acids, (d) carbonyl chloride, (e) aldehydes and dialdehydes, (f) ketenes, (g) lactones, and (h) epoxides. When employing cross-linking agents it is desirable to remove any undesirable residues or by-products resulting therefrom prior to any further processing. The technique of employing cross-linking agents to insolubilize particular film-forming materials is also well known in the art.

No matter which technique is employed for insolubilizing the film-forming materials so as to ultimately form agglomerated particles of the insolublized film-forming material having blended therethrough the tobacco dust, the amount of film-forming material that is employed with the tobacco dust on a dry weight basis can range anywhere from 1 part polymer/100 parts tobacco dust up to 100 parts polymer/100 parts tobacco dust. The upper limit for the amount of film-forming material employed is dependent merely on economics. Thus, even on a 1:1 ratio of film-forming material to tobacco dust, no drainage problems on the wire screen are at all encountered during the subsequent paper-making steps. However, it is not at all necessary to employ a 1:1 ratio in order to obtain the benefits of the present invention. Consequently, the preferred ratio is the employment of greater than about 5 parts film-forming material/100 parts tobacco dust and most preferred is a ratio of 8 to 20 parts of film-forming material/100 parts tobacco dust.

It is understood, of course, that although the foregoing discussion of the invention describes the addition of the tobacco dust to a dispersion or solution of film-forming polymer, it is also possible, if desired, to dry mix the tobacco dust and film-forming material along and then add the dry mixture to the solvent. Alternatively, a direct extrusion technique may be applied with a thermoplastic resin: see U.S. Pat. No. 3,012,562 to Merritt which is incorporated herein by reference.

As mentioned earlier, other bonding materials which cause bonding and agglomeration of the tobacco dust by themselves include cross-linking agents. These cross-linking agents may comprise the very same cross-linking agents discussed above which were employed for insolubilizing the film-forming materials in order to impart water resistance thereto. Here, however, the cross-linking agents are not employed to react and cross-link with a film-forming material, but rather, are employed to react and cross-link with various constituents which are generally already present and contained in the tobacco dust. Such tobacco dust constituents include carbohydrates, proteins and other amino compounds. Suitable cross-linking agents for reacting and cross-linking with these tobacco dust constituents include (a) polyfunctional acids (two or more carboxylic groups), (b) acid chlorides of the polyfunctional carboyxlic acids (e.g., adipoyl choride, etc.), (c) acid anhydrides of polyfunctional carboxylic acids, (d) carbonyl chloride, (e) aldehydes and dialdehydes, (f) ketenes, (g) lactones, and (h) epoxides. The cross-linking agents may be used alone or in combination with each other.

When employing these cross-linking agents, the tobacco dust may be used as is or is preferably first extracted with water to remove the desirable soluble components therefrom prior to cross-linking. The soluble components are restored to the bonded tobacco dust only after the bonded dust has been further extracted to remove any undesirable residues or by-products resulting from the cross-linking step. If the tobacco solubles are not removed prior to the cross-linking step they are then undesirably lost in the subsequent extraction step.

The amount of cross-linking agents employed with the tobacco dust is generally dependent upon how rigid the bonded dust particles are desired to be. Usually, about 2 to 10% by dry weight of cross-linking agents is added to the tobacco dust, based on the dry weight of the tobacco dust.

The cross-linking agents may be added to the tobacco dust by, for example, spraying them onto the dust or adding them to a tobacco dust slurry.

After spraying the cross-linking agents onto the tobacco dust which is generally present on a moving conveyor belt, the sprayed dust is then subjected to heat and pressure of up to 140° C. and 800 pounds per linear inch in order to cause the actual cross-linking. The heat and pressure may be applied to the sprayed dust by passing it through heated press rollers or through an extruder.

When the cross-linking agents are added to a tobacco dust slurry, the slurry is then mixed and cast onto a moving belt. The cast slurry is then subjected to temperature and pressure conditions which cause the actual cross-linking to occur.

In yet another alternative embodiment, it is also possible to dry mix the cross-linking agents with the tobacco dust and then add the mixture to an appropriate solvent after which it is cast and allowed to cross-link.

Bonding materials which cause indirect bonding and agglomeration of the tobacco dust include calcium sequestering agents such as diammonium phosphate; lower polyfunctional carboxylic acids such as oxalic, citric, malic and maleic acids; carbonate, bicarbonate and phosphate salts; and the like.One or more sequestering agents may be employed at one time. When the tobacco dust is treated with a calcium sequesting agent in the presence of a base such as ammonium hydroxide, potassium hydroxide, sodium hydroxide and the like, the tobacco pectin which is naturally found in its calcium pectate water insoluble form is released and solubilized. The released pectin, which is a film-forming material, may then be insolubilized by any of the techniques discussed above for insolubilizing film-forming materials in order to bond and agglomerate the tobacco dust. The employment of tobacco derived pectins as bonding agents is disclosed, for example, in U.S. Pat. Nos. 3,499,454 and 3,420,241, the contents of which are incorporated by reference.

Generally, the amount of calcium sequestering agent added to the tobacco dust is such that an effective amount of pectin is released from the dust and solubilized. This amount is dependent upon the extent of polyvalent ions present in the tobacco dust and in the water employed to make the tobacco dust slurry. It is generally desirable to add sequestering agents to the tobacco dust in an amount which is up to 30% in excess of the number of chemical equivalents of polyvalent ions (particularly calcium ions) which are present in the tobacco dust and in the water. Thus, as is well known to one skilled in the art, the amount of sequestering agents added is therefore dependent upon the equivalent weight of the particular agent employed. For diammonium phosphate, for example, up to about 7.5% by dry weight is added to the tobacco dust, based on the dry weight of the dust.

Instead of adding the sequestering agent to a tobacco dust slurry, it is also possible to first dry mix the agent and dust together and then add the mixture to the water. In either alternative, the slurry should be adjusted to have a pH of about 8.5 to 9. After the slurry is thoroughly mixed, it is then heated to a temperature of about 50°–70° C., cast onto a moving belt and then particulated as desired.

The pectin and other polysaccharides naturally occurring in the tobacco dust such as hemicellulose may also be removed and solubilized by subjecting the tobacco dust to a mild alkaline treatment. Once the polysaccharide is solubilized, it may then also be treated as discussed above to any of the film-forming insolubilization techniques so that bonding and agglomeration of the tobacco dust occurs.

After the tobacco dust has been added to the bonding material which is present as either a dispersion or solution (or after the tobacco dust is dry mixed with a bonding material and then added to a solvent), the resulting mixture is then thoroughly blended so as to form a uniform, homogeneous mixture. This mixture is then treated by any of the above-described methods in order to either insolubilize the film-forming material added to or released from the tobacco dust or allowed to cross-link if a cross-linking agent has been added.

It is to be understood that the shape of the resulting bonded tobacco dust material is not at all critical to the process of the present invention. Thus, as noted above, the mixture of the bonding material and tobacco dust may be spun into fibers or extruded into other shapes and then chopped as desired. Alternatively, a sheet may first be formed which is then shredded for employment in the subsequent paper-making steps. What is required in the present invention is that the tobacco dust particles are, in fact, agglomerated with the bonding material so as to effectively increase their size so that they no longer pass through or clog the wire screen of the paper-making machine. Although preferably the bonding material/tobacco dust mixture is insolubilized/cross-linked in the form of fibers which are easily and conveniently handled, any desirable shape is equally effective and applicable in the process of the present invention.

While the particular shape of the bonded and agglomerated tobacco dust is not critical to the present invention, the dimensions of the bonded material are. Thus, it is desirable that the agglomerated tobacco dust particles are of a size such that they do not pass through a 56 mesh screen. More preferably, however, the agglomerated particles should be of such size that they do not pass through a 20 mesh screen.

After the bonding material/tobacco dust has been insolubilized/cross-linked by any of the methods described above to form agglomerated particles, these particles are then added to a tobacco-parts slurry. The tobacco-parts slurry used in the present invention is prepared by any of the processes well known in the art for preparing reconstituted tobacco. (See, for example, U.S. Pat. No. 3,409,026 incorporated herein by reference.) In general, the tobacco-parts slurry is formed in the following manner. Tobacco by-product materials, such as stems, fines, etc., are mixed with water to form a slurry and then refined. Of course, the tobacco parts slurry employed in the process of the present invention does not include tobacco dust therein. A reconstituted tobacco sheet is formed from the slurry either by a paper-making process, by casting the slurry, or by extrusion. The present invention is particularly advantageous with the paper-making process for preparing reconstituted tobacco material.

Generally, the amount of agglomerated dust particles that is added to the tobacco-parts slurry is such that up to 60% of the total of the agglomerated dust particles and tobacco-parts in the resulting admixed slurry consists of agglomerated dust particles, based on a dry weight basis. Preferably, about 10 to 40% of the total of agglomerated dust particles and tobacco parts in the admixed slurry consists of agglomerated particles, on a dry weight basis. It is to be understood that the upper limit of about 60% agglomerated particles present in the admixed slurry that is taught above is the approximate maximum amount of agglomerated dust particles that should be employed when desiring to obtain a conventional reconstituted tobacco sheet prepared by a paper-making process which possesses generally acceptable physical and smoking characteristics. It is quite possible in the process of the present invention to have up to 90% or more agglomerated particles in the admixed slurry with the understanding, of course, that the more agglomerated particles employed over and above the 60% amount, the greater the departure and the more deviation there will be from producing a conventional reconstituted tobacco sheet prepared by a paper-making process.

After adding the agglomerated particles to the tobacco-parts slurry, the slurry is thereafter mixed by techniques conventional in the art such that a thorough blending of the components takes place to form a uniform homogeneous mixture. The mixed slurry is then transferred to a paper-making apparatus (e.g., Fourdrinier, etc.) in which the desired reconstituted tobacco sheet is formed. The preparation of reconstituted tobacco material by means of a paper-making process is well known in the art as exemplified by Canadian Pat. No. 862,497 which has been incorporated herein by reference.

Generally, after a sheet of reconstituted tobacco material containing the agglomerated particles of tobacco dust has been formed by means of the paper-making process, it is then dried and cut into particulate material similar in physical form to ordinary smoking tobacco and so used alone, or mixed with natural leaf tobacco, and then cut or shredded in the usual manner. When in the form of a sheet or strip, the reconstituted tobacco smoking material can be split into thin strips for twisting or intertwisting with other strips to form strands which can be cut into lengths suitable for use in filling machines for the fabrication of cigars, cigarettes or as a pipe tobacco substitute. The strands of the smoking material so produced can be used alone, or if desired, can be blended with strands of natural tobacco for admixture therewith in various proportions to produce a smoking material.

The method of the present invention can be carried out on either a continuous or batch basis. An illustration of applying one of the coagulation techniques discussed above in conjunction with a continuous paper-making process is as follows:

80 to 95 parts by weight of tobacco dust is dry blended with 5 to 20 parts by weight of an organic solvent soluble, water-insoluble, polymer such as ethyl hydroxyethyl cellulose. This dry mixture is then added to a water soluble organic solvent such as ethanol or acetic acid to produce a low-to-medium viscosity slurry of preferably less than 4,000 cps. The formed slurry is then extruded into a tobacco-parts water slurry (or into water alone). The extruded polymer/tobacco dust slurry immediately precipitates into larger agglomerated particles as it contacts the water of the tobacco-parts slurry. These particles may be in the shape of fibers, flakes, etc. depending upon the particular type of die that is used to extrude the polymer/dust slurry. The coagulation or precipitation is achieved as the organic solvent escapes from the extruded slurry into the water phase of the tobacco-parts slurry and the water insoluble polymer precipitates as a result of this change in the solution phase. The combined materials are then transferred to the machine drainage wire screen for sheet formation.

The preceding illustration also readily lends itself to a batch operation in which the organic solvent slurry is extruded into plain water to form the desired agglomerated particles which can be added later to a tobacco-parts slurry for use in a reconstitution process.

An illustration of another dust agglomeration method that is applicable in a continuous operation comprises adding tobacco dust to a water slurry of a water-soluble salt of chitosan (acetate, chloride, etc.) or of alginic acid (Na, K, $NH_4$, etc.) and then extruding the slurry into a tobacco-parts slurry of appropriate pH. For chitosan salts, the pH would be greater than 7; for alginates, less than 7; alginates could also be precipitated by the presence of multivalent metal water-soluble salts in the tobacco parts slurry.

In a batch or semicontinuous operation, the preceding method is modified by extruding the bonding material/tobacco dust slurry into water containing, if necessary, a dissolved precipitant as specified above. The precipitate is drained and washed for storage and subsequently is added to a tobacco-parts slurry for further processing into sheet form.

After formation of the precipitate, it is generally desirable to wash the precipitate so as to remove undesirable residues or by-products before further processing. In a continuous process, the washing can be accomplished by first separately forming the agglomerated-particles slurry, draining and washing the particles, and then adding the washed particles to the tobacco-parts slurry. Alternatively, the washing may be done after the reconstituted sheet is formed by washing the sheet. In a batch or semicontinuous process, the agglomerated-particles slurry is drained and washed before storage and prior to subsequent admixing with a tobacco-parts slurry. In view of this washing step, it may also be desirable to pre-extract the tobacco dust with water in order to recover desirable tobacco solubles which are present therein. These tobacco solubles are then added to the resulting reconstituted tobacco. An illustration of this scheme is to extract the tobacco dust, form the dust into a slurry with either water soluble chitosan or alginic acid salts and then extrude/pulp the slurry into a coagulation tank that contains water solutions of the aforementioned insolubilizing agents. The precipitated "pulp" is then washed and added to a conventional tobacco-parts slurry for further processing.

In yet another embodiment, it is possible to treat the tobacco dust so as to form agglomerated particles of tobacco dust in conjunction with insolubilized film-forming material and store this material to be used at a later date at which time it is admixed with a tobacco-parts slurry and processed by means of a paper-making technique. In such an embodiment, the precipitated/-coagulated dust, after being preferably washed, is then dried and has the solubles that were pre-extracted therefrom reapplied. Since this mode of operation is more energy demanding since the agglomerated particles must be dried, it is obviously less preferred. A more practical approach where it is desired to treat tobacco dust to be used at a future date is to preblend the dust with a thermoplastic, water insoluble polymer or with an organic solvent soluble polymer wherein the polymer/dust blend could then be extruded/molded into larger pieces for future "pulping" with a tobacco-parts slurry for subsequent processing via a paper-making technique. In such an embodiment, heat is applied to soften the thermoplastic polymer or a small amount of solvent is employed to swell the polymer and cause it to adhere by applying pressure and/or heat. In this manner, very little solvent and/or energy is required.

The reconstituted tobacco material produced by the present invention, due to the presence of the agglomerated tobacco dust particles, is less dusty and stronger than reconstituted tobacco made by prior art techniques which do not employ such agglomerated particles.

Having described the basic concepts of this invention, the following Examples are set forth to illustrate the same. They are not, however, to be construed as limiting the invention in any manner.

EXAMPLE 1

The following materials were introduced into a laboratory blender in the sequence shown and whipped into a slurry. Parts are by weight.

| | |
|---|---|
| water | 900 |
| sodium alginate | 20 |
| tobacco leaf dust (less than 40 mesh) | 80 |

Half of the slurry was forced through a narrow glass tubeinto a 25% aqueous calcium chloride solution adjusted to a pH of 4 with hydrochloric acid. Fibers with good integrity resulted, having enough tenacity to retain their form on removal from the bath. The other half of the slurry was cast into a sheet which was dried, shredded, and treated with a like calcium chloride solution. Both fibers and shreds were then washed with water.

A pulp of tobacco-parts as prepared by the process of Canadian Pat. No. 862,497 before the sheet-forming operation was mixed with the fibers or the shreds prepared above as follows: a portion of pulp with equal parts (solid weight basis) of fibers; a portion with one-half part (solids) of fibers; and two pulp mixtures in the same proportions with shreds. These were hand-made into sheets on a wire and all of the sheeets had normal handling properties.

EXAMPLE 2

A slurry prepared according to the formula of Example 1 was extruded as in Example 1 into (1) a bath of aqueous hydrochloric acid, pH 1.5, and (2) a bath of HCl in acetone. Both produced fibrils and fibers which were combined with tobacco pulp and converted without difficulty into hand sheets.

EXAMPLE 3

The sodium alginate of Example 1 was replaced by an equal weight of chitosan acetate and slurried with leaf dust in a blender. A first portion of the slurry was spun by pouring a very fine stream into aqueous ammonia to form fibers; a second portion was spun into a bath of ammonia in ethanol. Both sets of fibers were water-insensitive; they were blended into portions of pulped tobacco-parts as before, at 1:1 solids ratios, and hand sheets were prepared.

EXAMPLE 4

The following were introduced into a laboratory blender operating at slow speed to prepare a slurry. Parts are by weight.

| | |
|---|---|
| ethanol | 700 parts |
| ethyl hydroxyethyl cellulose | 20 |
| tobacco leaf dust | 80 |

The slurry was spun into the vortex of an agitated water bath by pouring the slurry slowly as a very thin stream. The resulting fibers were formed without further ingredients into a paper hand sheet. Paper forming was also employed with a pulp of tobacco-parts in water having the fibers added. This sheet was found to contain 44% of the spun material in its matrix and it was of acceptable quality for further processing.

A similar formulation for the spinning slurry but with isopropanol replacing the ethanol was spun into a water bath as above. The fibrous mass was then made into a sheet with paper hand-making equipment. These sheets were then pressed between felt with a hand press and the moisture content (oven voltatiles or OV) was determined (by drying in a 110° C. oven three hours) to be 52.8%. This is significantly lower than that of reconstituted tobacco sheet made with the same equipment from tobacco pulp.

EXAMPLE 5

A procedure similar to that of Example 4 was followed with a slurry comprising:

| | |
|---|---|
| acetone | 700 parts |
| cellulose acetate | 20 |
| tobacco leaf dust | 80 |

to produce fibers having good water resistance. Similar acceptable results were also obtained when the slurry was extruded into a basic water bath to regenerate the cellulose.

An alternative procedure with any of the foregoing formulations of Examples 1 through 5 was to dry-blend the tobacco dust with the binder and then add the mixture to the solvent in the blender.

EXAMPLE 6

200 grams of tobacco dust that passed through a 60 mesh screen is added to 800 grams of water and slurried. To this, enough ammonium hydroxide is added to the slurry to adjust it to a pH of 8.5. To this slurry, 15 grams (7.5% of the dry weight of the tobacco dust) of diammonium phosphate are added. The slurry is then homogenized, cast onto a conveyor belt, an insolubilizing agent, glyoxal, is then added by spraying and the product is then dried at a temperature of 190° C. for 1.5 minutes.

The bonded tobacco dust sheet thus produced is then particulated and admixed with a pulped tobacco-parts slurry, at 1:1 solids ratio, and hand sheets are prepared.

EXAMPLE 7

200 grams of tobacco dust are sprayed with 10 grams of citric acid, a cross-linking agent. The sprayed tobacco dust is then passed through a pair of heated rollers maintained at a temperature of 140° C. and a pressure of 800 pounds per linear inch. The cross-linked tobacco dust is then particulated and admixed with a pulped tobacco-parts slurry at 1:1 solids ratio, and hand sheets were prepared.

EXAMPLE 8

6 g of ethyl hydroxyethyl cellulose was dissolved in 50 ml of ethanol. To this, 24 g of tobacco dust that passed through a 60 mesh screen was added and slurried. This slurry was then extruded at the vortex of agitated water in a laboratory blender to form a fibrous "pulp." The pulp ws removed by filtering the mass and it was then added to 1000 ml of water with agitation.

The drainage characteristics of the pulp produced in this example were compared respectively with like amounts of unprocessed dust and a conventional tobacco-parts slurry. The three samples were tested for their drainage characteristics using a standard ASTM drainage testing machine (Testing Machine Inc. of N.Y.), and it was found that the extruded dust/fibrous pulp drained much easier than the unprocessed dust itself or than conventional tobacco pulp. The Table below lists the drainage volumes obtained by the standard freeness test, Technical Association of Pulp and Paper Industry Method (TAPPI) No. T227 os-58.

TABLE

| Sample | Freeness, (cc of $H_2O$) |
|---|---|
| Extruded fibrous pulp (with solubles) | 930 |
| Tobacco dust (with solubles) | 490 |
| Tobacco pulp (no solubles) | 475 |

NOTE:
The samples were filtered through a TAPPI standard screen to obtain freeness numbers.

Variations and modifications may, of course, be made without departing from the spirit and scope of the present invention.

Having thus described our invention, what we desire to secure byLetters Patent is:

1. A method for employing tobacco dust in the preparation of reconstituted tobacco which comprises:
(a) admixing tobacco dust with a bonding material to form a mixture;
(b) treating the mixture to form water resistant agglomerated particles;
(c) admixing the agglomerated particles with a tobacco-parts slurry; and
(d) forming the slurry into a sheet by means of a paper-making process, drying and then shredding the resultant reconstituted tobacco sheet.

2. The method of claim 1, wherein the bonding material and the tobacco dust are dry mixed and then added to a solvent.

3. The method of claim 1, wherein the bonding material is present in an aqueous medium.

4. The method of claim 1, wherein the agglomerated particles are admixed with the tobacco-parts slurry such that about 10 to 40% by dry weight of the total amount of agglomerated particles and tobacco-parts present in the resulting admixed slurry consists of the agglomerated particles

5. The reconstituted tobacco produced by the method of claim 1.

6. A method for employing tobacco dust in the preparation of reconstituted tobacco which comprises:
(a) admixing tobacco dust with a film-forming material to form a mixture;
(b) treating the mixture to form agglomerated particles;
(c) admixing the agglomerated particles with a tobacco-parts slurry; and
(d) forming the slurry into a sheet by means of a paper-making process, drying and then shredding the resultant reconstituted tobacco sheet.

7. The method of claim 6, wherein greater than about 1 part by weightof film-forming material is admixed with 100 parts by weight of tobacco dust.

8. The method of claim 7, wherein greater than about 5 parts by weight of film-forming material is admixed with 100 parts by weight of tobacco dust.

9. The method of claim 6, wherein the film-forming material has thermoplastic properties.

10. The method of claim 6, wherein the film-forming material is present in an organic solvent medium.

11. The method of claim 10, wherein the organic solvent medium is water soluble.

12. The method of claim 11, wherein the mixture of tobacco dust and film-forming material is agglomerated by spinning the mixture into a water bath.

13. The method of claim 10, wherein the mixture of tobacco dust and film-forming material is agglomerated by dry spinning.

14. The method of claim 6, wherein the mixture of tobacco dust and film-forming material is agglomerated by spinning the mixture into a medium in which the film-forming material is insoluble.

15. The method of claim 6, wherein the mixture of tobacco dust and film-forming material is agglomerated by casting the mixture into a sheet, drying the sheet and then either before or after shredding the sheet, treating it with an insolubilizing agent.

16. The method of claim 6, wherein the film-forming material is a polysaccharide.

17. The method of claim 16, wherein the polysaccharide is selected from the group consisting of natural gums, algins, pectins, chitosan, xanthomonas gum, salts thereof and combinations thereof.

18. The method of claim 2, wherein the film-forming material is a polysaccharide derivative.

19. The method of claim 18, wherein the polysaccharide derivative is selected from the group consisting of cellulose ethers and esters, carboxymethyl cellulose (CMC), carboxymethyl guar, methyl cellulose, ethyl cellulose, ethyl hydroxyethyl cellulose, hydroxypropyl cellulose, cellulose acetate and combinations thereof.

20. The method of claim 6, wherein the film-forming material is a synthetic thermoplastic material.

21. The method of claim 20, wherein the synthetic thermoplastic material is selected from the group consisting of polyvinyl alcohol, polyvinyl acetate, polyacrylic acid, copolymers of methyl vinyl ether and maleic anhydride, salts thereof and combinations thereof.

22. The method of claim 6, wherein the film-forming material and tobacco dust mixture is agglomerated by subjecting it to cross-linking agents.

23. The method of claim 22, wherein the cross-linking agents are selected from the group consisting of polyfunctional acids, acid chlorides of the polyfunctional carboxylic acids, acid anhydrides of polyfunctional carboxylic acids, carbonyl chloride, aldehydes and dialdehydes, ketenes, lactones, epoxides and combinations thereof.

24. A reconstituted tobacco produced by the method of claim 2, wherein said film-forming material is a polysaccharide or a polysaccharide derivative.

25. A reconstituted tobacco produced by the method of claim 6, wherein said film-forming material is a synthetic thermoplastic material.

26. A method for employing tobacco dust in the preparation of reconstituted tobacco which comprises:

(a) admixing tobacco dust with a cross-linking agent to form a mixture;
(b) treating the mixture to form agglomerated particles;
(c) admixing the agglomerated particles with a tobacco-parts slurry; and
(d) forming the slurry into a sheet by means of a paper-making process, drying and then shredding the resultant reconstituted tobacco sheet.

27. The method of claim 26, wherein about 2 to 10% bydry weight of cross-linking agent is admixed with the tobacco dust, based on the dry weight of the tobacco dust.

28. The method of claim 26, wherein the cross-linking agent is selected from the group consisting of polyfunctional acids, acid chlorides of the polyfunctional carboxylic acids, acid anhydrides of polyfunctional carboxylic acids, carbonyl chloride, aldehydes and dialdehydes, ketenes, lactones, epoxides and combinations thereof.

29. A reconstituted tobacco produced by the method of claim 26, wherein said cross-linking agent is selected from the group consisting of polyfunctional acids, acid chlorides of the polyfunctional carboxylic acids, acid anhydrides of polyfunctional carboxylic acids, carbonyl chloride, aldehydes and dialdehydes, ketenes, lactones, epoxides and combinations thereof.

30. A method for employing tobacco dust in the preparation of reconstituted tobacco which comprises:

(a) admixing tobacco dust with a calcium sequestering agent to form a mixture;
(b) treating the mixture to form agglomerated particles;
(c) admixing the agglomerated particles with a tobacco-parts slurry; and
(d) forming the slurry into a sheet by means of a paper-making process, drying and then shredding the resultant reconstituted tobacco sheet.

31. The method of claim 30, wherein the calcium sequestering agent is admixed with the tobacco dust in an amount up to 30% in excess of the chemical equivalents of polyvalent ions present in the tobacco dust.

32. The method of claim 30, wherein the calcium sequesteringagent is selected from the group consisting of diammonium phosphate, lower polyfunctional carboxylic acids, carbonate, bicarbonate and phosphate salts, and combinations thereof.

33. A reconstituted tobacco produced by the method of claim 30, wherein said calcium sequestering agent is selected from the group consisting of diammonium phosphate, lower polyfunctional carboxylic acids, carbonate, bicarbonate and phosphate salts, and combinations thereof.

34. A method of producing a smoking material comprising:

(a) admixing tobacco dust with an aqueous solution of a polysaccharide;
(b) extruding the mixture into a medium which insolubilizes the polysaccharide forming insolubilized, water-resistant fibers of polysaccharide having tobacco dust substantially uniformly blended therethrough;
(c) adding the fibers to a tobacco-parts slurry; and
(d) forming the slurry into a sheet by means of a papermaking process, drying and then shredding the resultant reconstituted tobacco sheet.

35. A method of producing a smoking material comprising:

(a) admixing tobacco dust with a non-aqueous solution of cellulose ether or ester;
(b) extruding the mixture into a water bath thereby insolubilizing the cellulose ether or ester forming insolubilized, water-resistant fibers having tobacco dust substantially uniformly blended therethrough;
(c) adding the fibers to a tobacco-parts slurry; and
(d) forming the slurry into a sheet by means of a paper-making process, drying and then shredding the resultant reconstituted tobacco sheet.

* * * * *

UNITED STATES PATENT AND TRADEMARK OFFICE

CERTIFICATE OF CORRECTION

PATENT NO. : 4,341,228

DATED : July 27, 1982

INVENTOR(S) : Gus D. Keritsis and David A. Lowitz

It is certified that error appears in the above—identified patent and that said Letters Patent is hereby corrected as shown below:

Column 13, line 23, change "2" to --6--.

Column 13, line 50, change "2" to --6--.

Signed and Sealed this

*Thirteenth* Day of *November 1984*

[SEAL]

*Attest:*

GERALD J. MOSSINGHOFF

*Attesting Officer*

*Commissioner of Patents and Trademarks*